US009291013B2

(12) United States Patent
Angelle et al.

(10) Patent No.: US 9,291,013 B2
(45) Date of Patent: Mar. 22, 2016

(54) APPARATUS TO WIPE A TUBULAR MEMBER

(75) Inventors: Jeremy Richard Angelle, Lafayette, LA (US); Robert Thibodeaux, Lafayette, LA (US); John Erick Stelly, Breaux Bridge, LA (US)

(73) Assignee: Frank's International, LLC, Houston, TX (US)

( * ) Notice: Subject to any disclaimer, the term of this patent is extended or adjusted under 35 U.S.C. 154(b) by 971 days.

(21) Appl. No.: 13/331,759

(22) Filed: Dec. 20, 2011

(65) Prior Publication Data

US 2013/0153302 A1 Jun. 20, 2013

(51) Int. Cl.
*E21B 21/015* (2006.01)
*E21B 17/00* (2006.01)

(52) U.S. Cl.
CPC ..... *E21B 21/015* (2013.01); *E21B 17/006* (2013.01); *Y10T 29/49826* (2015.01)

(58) Field of Classification Search
CPC ..... E21B 33/08; E21B 37/00
See application file for complete search history.

(56) References Cited

U.S. PATENT DOCUMENTS 4,690,213 A * 9/1987 Stannard et al. ..... 166/84.4
5,101,896 A 4/1992 Thompson et al.
5,526,877 A 6/1996 Winz
5,642,793 A 7/1997 Ljøsne
6,059,052 A 5/2000 Haggard
7,762,343 B2 7/2010 Sonneveld et al.
8,028,750 B2 10/2011 Hughes et al.
2008/0035333 A1 2/2008 Newman
2010/0116558 A1 5/2010 Angelle et al.

OTHER PUBLICATIONS

Office Action for corresponding U.S. Appl. No. 13/331,790, mailed Nov. 7, 2013 (15 pages).
Office Action in related U.S. Appl. No. 13/331,790, mailed Oct. 2, 2014 (15 pages).
International Preliminary Report on Patentability in corresponding International Application No. PCT/US2012/070500, mailed Jun. 24, 2014 (13 pages).
International Search Report and Written Opinion issued in Application No. PCT/US2012/070500, dated Apr. 26, 2013 (18 pages).

* cited by examiner

*Primary Examiner* — Jennifer H Gay
*Assistant Examiner* — Caroline Butcher
(74) *Attorney, Agent, or Firm* — Osha Liang LLP

(57) ABSTRACT

An apparatus and method to wipe a tubular member includes a first wiper section and a second wiper section, in which the first wiper section and the second wiper section are movable with respect to each other towards a point of convergence. The apparatus may further include a base having an aperture formed therein to receive the tubular member such that the first wiper section and the second wiper section are connected to the base and movable with respect to the base between an open position and a closed position.

21 Claims, 4 Drawing Sheets

APPARATUS TO WIPE A TUBULAR MEMBER

BACKGROUND OF DISCLOSURE

1. Field of the Disclosure

Embodiments disclosed herein generally relate to methods and apparatuses to remove drilling fluids from a tubular member. More specifically, embodiments disclosed herein relate to an apparatus that is used to wipe tubular members as the tubular members are removed from a downhole well location.

2. Background Art

When drilling oil wells, the drill string typically includes several sections of tubular members, such as drill pipe, threaded together in an end-to-end fashion to make up a continuous drillstring. From time-to-time, the drillstring must be raised or "tripped" out of the hole, such as when changing the drill bit at the end of the string. As the drillstring is brought out of the hole, the various tubular members are removed from the string and set aside in or around the drilling rig. However, when doing this, the tubular members may have drilling fluids and/or debris deposited thereon, such as oil or water-based mud and cuttings from the drilled underground formations.

For example, when drilling downhole, the cuttings formed from the borehole with the drill bit at the bottom of the string may need to be removed from the wellbore, and the well head may need to be maintained at a predetermined hydrostatic pressure. Drilling mud is then pumped down through a bore of the drill pipe where the mud exits the drill bit, and is circulated back uphole in the annular space between the drill pipe and the borehole. As such, as the string of tubular members is brought up and removed from the wellbore, mud, whether oil-based or water-based mud, may cling to the outer surface of the tubular members.

One way to remove drilling mud from the tubular members is to have a drilling rig crew member wash down the tubular members with a hose or the like as the tubular members emerge from the borehole. However, this may lead to a loss of valuable drilling fluid that may otherwise be reused in the drilling process, or may further lead to having mud being cast off and onto the rig floor and/or in the areas of the pipe handling equipment, presenting both concerns related to the safety of the workers and concerns related to the proper maintenance of the equipment in the rig. In addition, water used to clean the tubular members may dilute the drilling fluid in the wellbore and affect the mud weight.

Another way to remove mud from the tubular members is to include a one-piece wiper with the pipe handling equipment, in which the wiper may be used to remove excess mud from tubular members passing through the pipe handling equipment. However, this may lead to the wiper wearing out more rapidly, as the wiper may be engaging and wiping the outer surface of the tubular members when passing the tubular members both downhole and uphole. Furthermore, these wipers may not be readily accessible or removable, and therefore may require a significant amount of downtime within the drilling rig to replace the wipers.

Accordingly, there exists a need that may address these concerns, such as to more adeptly accommodate the mud that may be deposited on tubular members emerging from the borehole.

SUMMARY OF INVENTION

In one aspect, embodiments disclosed herein relate to an apparatus to wipe a tubular member. The apparatus includes a first wiper section and a second wiper section, in which the first wiper section and the second wiper section are movable with respect to each other towards a point of convergence.

In another aspect, embodiments disclosed herein relate to an apparatus to wipe a tubular member. The apparatus includes a base having an aperture formed therein to receive the tubular member, and a first wiper section and a second wiper section connected to the base and movable with respect to the base between an open position and a closed position.

In another aspect, embodiments disclosed herein relate to a method to manufacture an apparatus to wipe a tubular member. The method includes connecting a first wiper section to a base, and connecting a second wiper section to the base, in which the first wiper section and the second wiper section are movable with respect to each other.

In yet another aspect, embodiments disclosed herein relate to an apparatus to wipe a tubular member. The apparatus includes a first means for wiping the tubular member and a second means for wiping the tubular member, in which the first wiping means and the second wiping means are movable with respect to each other towards a point of convergence.

Other aspects and advantages of the invention will be apparent from the following description and the appended claims.

DETAILED DESCRIPTION

Figure 1A:
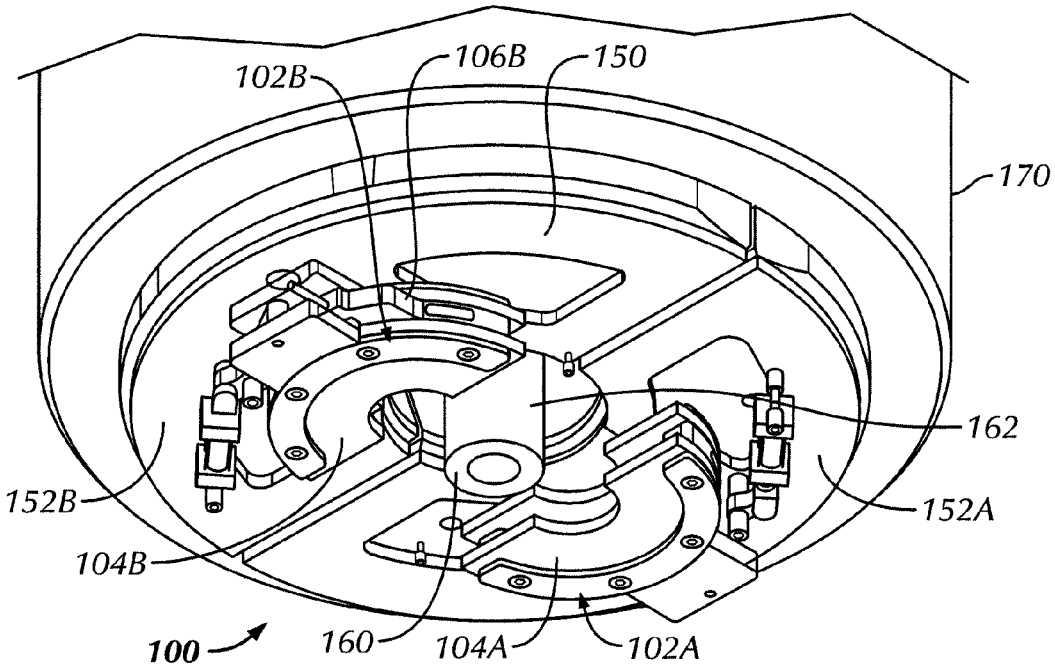
FIGS. 1A and 1B show perspective views of an apparatus to wipe a tubular member in accordance with one or more embodiments disclosed herein.

Specific embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the invention. However, it will be apparent to one of ordinary skill in the art that the embodiments disclosed herein may be practiced without these specific details. In other instances, well-known features have not been described in detail to avoid unnecessarily complicating the description.

Furthermore, those having ordinary skill in the art will appreciate that when describing connecting a first element to a second element, it is understood that connecting may be either directly connecting the first element to the second element, or indirectly connecting the first element to the second element. For example, a first element may be directly connected to a second element, such as by having the first element and the second element in direct contact with each other, or a first element may be indirectly connected to a second element, such as by having a third element, and/or additional elements, connected between the first and second elements.

In one aspect, embodiments disclosed herein generally relate to an apparatus, such as a wiper apparatus, that wipes a tubular member. The apparatus includes a first wiper section and a second wiper section, in which the first and second wiper sections are movable with respect to each other towards a point of convergence, such as towards the axis of a tubular member passing through the apparatus. The first wiper section and the second wiper section each may include a flexible material, such as by having a first flexible component within the first wiper section and a second flexible component within the second wiper section. The first flexible component of the first wiper section may be connected to a first rigid component, and the second flexible component of the second wiper section may be connected to a second rigid component. Dual wipers sections may also be used.

The apparatus may additionally include a base, such as by having the first wiper section and the second wiper section movable with respect to the base and removably connected to the base. Further, the apparatus may be disposed adjacent to a pipe handling apparatus, such as a spider assembly. An actuator may be connected between the first wiper section and/or the second wiper section and the base to move the first wiper section and the second wiper section with respect to each other, and the first wiper section and the second wiper section may be removably connected to the base using an attachment mechanism.

Figure 1B:
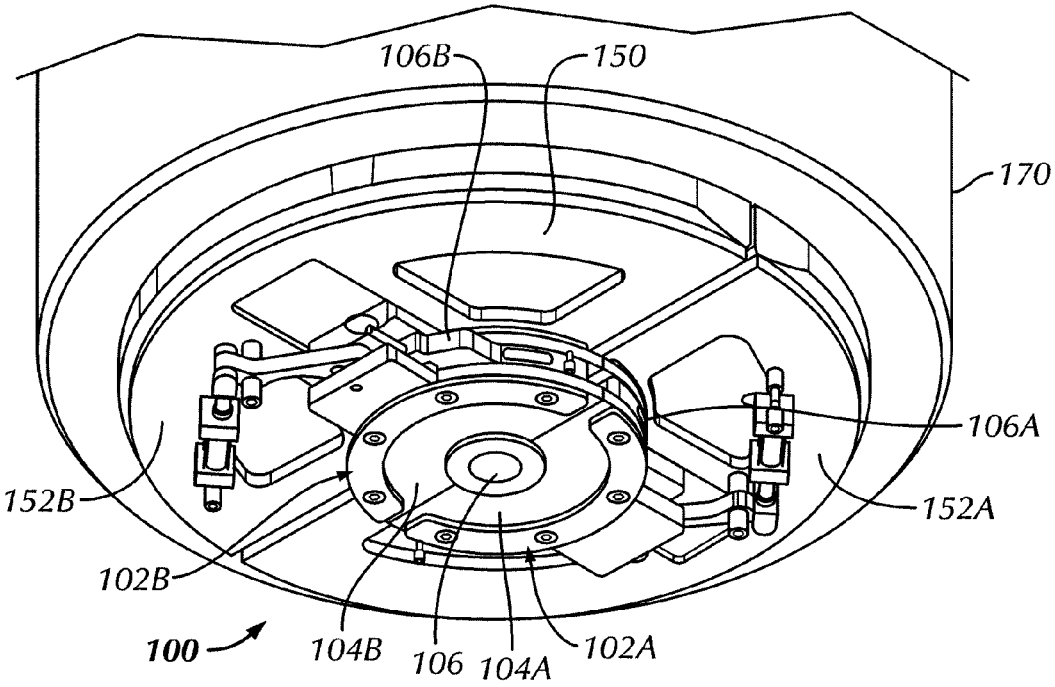

Referring now to FIGS. 1A and 1B, perspective views of an apparatus 100 to wipe a tubular member 160 in accordance with one or more embodiments disclosed herein are shown. FIG. 1A shows the apparatus 100 in an open position, and FIG. 1B shows the apparatus 100 in a closed position. In the open position, the apparatus 100 is positioned away form the tubular member 160 such that a gap is formed between the apparatus 100 and the tubular member 160. In the closed position, the apparatus 100 is positioned adjacent to the tubular member 160 such that the apparatus 100 may engage and wipe an outer surface 162 of the tubular member 160. As such, the apparatus 100 may be able to wipe an outer surface 162 of the tubular member 160 such as to remove fluid and/or debris (e.g., oil-based and/or water-based mud) from the outer surface 162 of the tubular member 160.

As shown in FIGS. 1A and 1B, the apparatus 100 includes a first wiper section 102A and a second wiper section 102B, in which the first and second wiper sections 102A and 102B may move with respect to each other. For example, the first and second wiper sections 102A and 102B may move with respect to each other between the open position and closed position towards a point of convergence, such as by moving with respect to each other towards an axis defined through the tubular member 160 and/or a pipe handling apparatus 170. Further, those having ordinary skill in the art will appreciate that more than two wiper sections may be used in accordance with embodiments disclosed herein, such as by having the apparatus formed of at least three wiper sections. In such an embodiment, the third wiper section may be movable with respect to the first wiper section and the second wiper section towards the same point of convergence as the first and second wiper sections.

The first wiper section 102A may include at least one flexible component 104A connected to a rigid component 106A, and the second wiper section 102B may include at least one flexible component 104B connected to a rigid component 106B. The flexible components may be formed from and/or include any flexible material known in the art, such as a rubber material and/or reinforced cloth material, that may be capable of engaging and wiping a surface of a tubular member. Further, as shown in FIGS. 1A and 1B, the first wiper section 102A may include two flexible components 104A, and the second wiper section 102B may include two flexible components 104B. However, those having ordinary skill in the art will appreciate that one or more flexible components may be included within either of the wiper sections, as the present disclosure contemplates embodiments including only one flexible component within a wiper section and also contemplates embodiments including at least three flexible components within a wiper section.

The first wiper section 102A and/or the second wiper section 102B of the apparatus 100 may be connected, such as removably connected, to a base 150, in which the base 150 may then be connected to the pipe handling apparatus 170. As shown in FIGS. 1A and 1B, the base 150 may include a first section 152A and a second section 152B. However, those having ordinary skill in the art will appreciate that the base may include more than two sections, or alternatively may include be formed of a single structure. In the embodiment shown in FIGS. 1A and 1B, the first wiper section 102A may be removably connected to the first section 152A of the base 150, and the second wiper section 102B may be removably connected to the second section 152B of the base 150.

Figure 2:
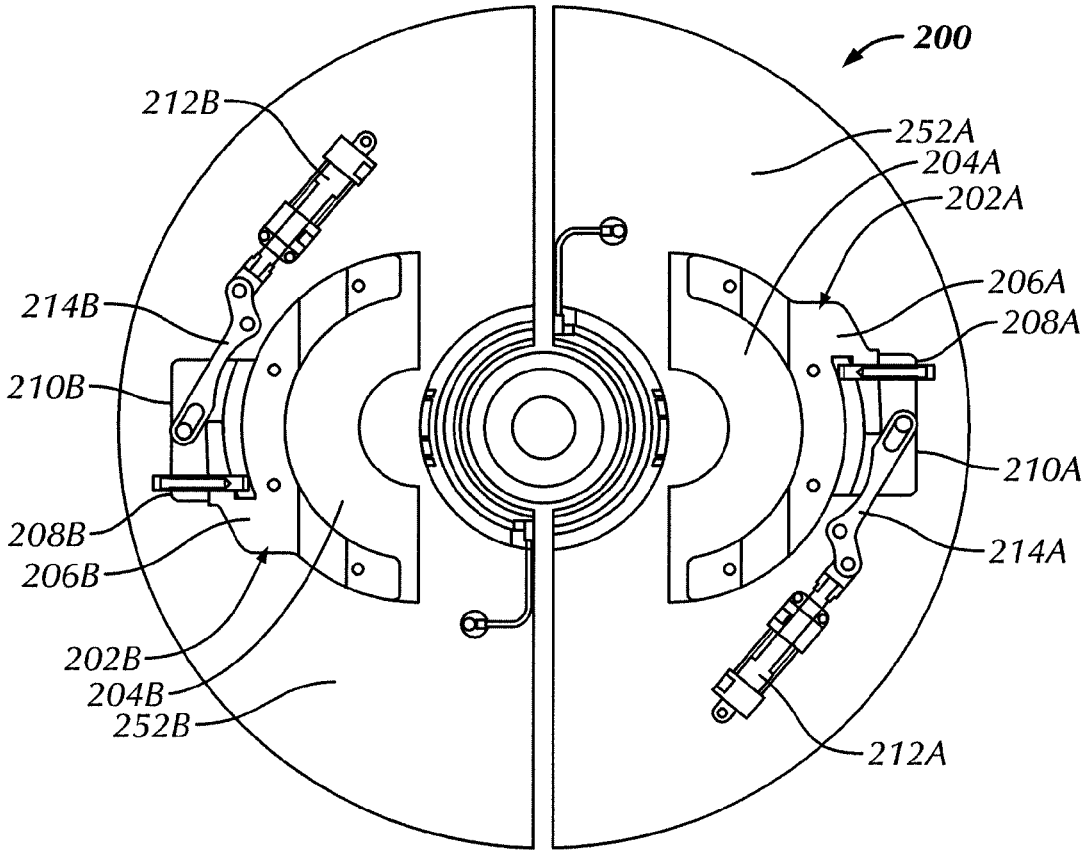
FIG. 2 shows a cross-sectional view of an apparatus to wipe a tubular member in accordance with one or more embodiments disclosed herein.

Accordingly, referring now to FIG. 2, a cross-sectional view of an apparatus 200 to wipe a tubular member 260 in accordance with one or more embodiments disclosed herein is shown. The apparatus 200 includes a first wiper section 202A and a second wiper section 202B connected to a base 250, in which the first wiper section 202A may be removably connected to a first section 252A of the base 250 and the second wiper section 202B may be removably connected to a second section 252B of the base 250.

As such, one or more attachment mechanisms 208A and 208B, such as a pin (as shown), a bolt, a screw, a clamp, a biasing device, or any other attachment mechanism known in the art, may be used to removably connect the first wiper section 202A and the second wiper section 202B to the base 250. Specifically, in the embodiment shown in FIG. 2, a rigid component 206A of the first wiper section 202A may be removably connected to a first translating block 210A through the first attachment mechanism 208A, and a rigid component 206B of the second wiper section 202B may be removably connected to a second translating block 210B through the second attachment mechanism 208B.

Further, the apparatus may include one or more actuators to move the apparatus between an open position and a closed position. As such, in FIG. 2, the apparatus 200 may include a first actuator 212A and a second actuator 212B, each connected to the base 250. The first actuator 212A may be connected to the translating block 210A through a first coupler link 214A, and the second actuator 212B may be connected to the second translating block 210B through a second coupler link 214B. As the actuators 212A and 212B actuate, the first actuator 212A may move the first wiper section 202A between the open and closed positions through the first coupler link 214A and the first translating block 210A, and the second actuator 212B may move the second wiper section 202B between the open and closed positions through the second coupler link 214B and the second translating block 210B.

The actuators may be hydraulic, pneumatic, electric, and/or any other type of actuator known in the art. Further, the present disclosure contemplates that other arrangements and configurations may be used to move the apparatus between the open and closed positions. For example, rather than having two actuators to move the first and second wiper sections between the open and closed positions, a single actuator may be arranged and connected between the first and second wiper sections and the base, such as with multiple coupler links, to control the movement of the first and second wiper sections.

Accordingly, other arrangements and configurations may be used to move the apparatus between the open and closed positions.

Furthermore, the apparatus may include one or more position sensors to detect the position of the apparatus. For example, a first position sensor may be coupled to the first actuator 212A, thereby enabling the first position sensor to detect the position of the first wiper section 202A within the apparatus 200, and a second position sensor may be coupled to the second actuator 212B, thereby enabling the second position sensor to detect the position of the second wiper section 202B within the apparatus 200.

Figure 3:
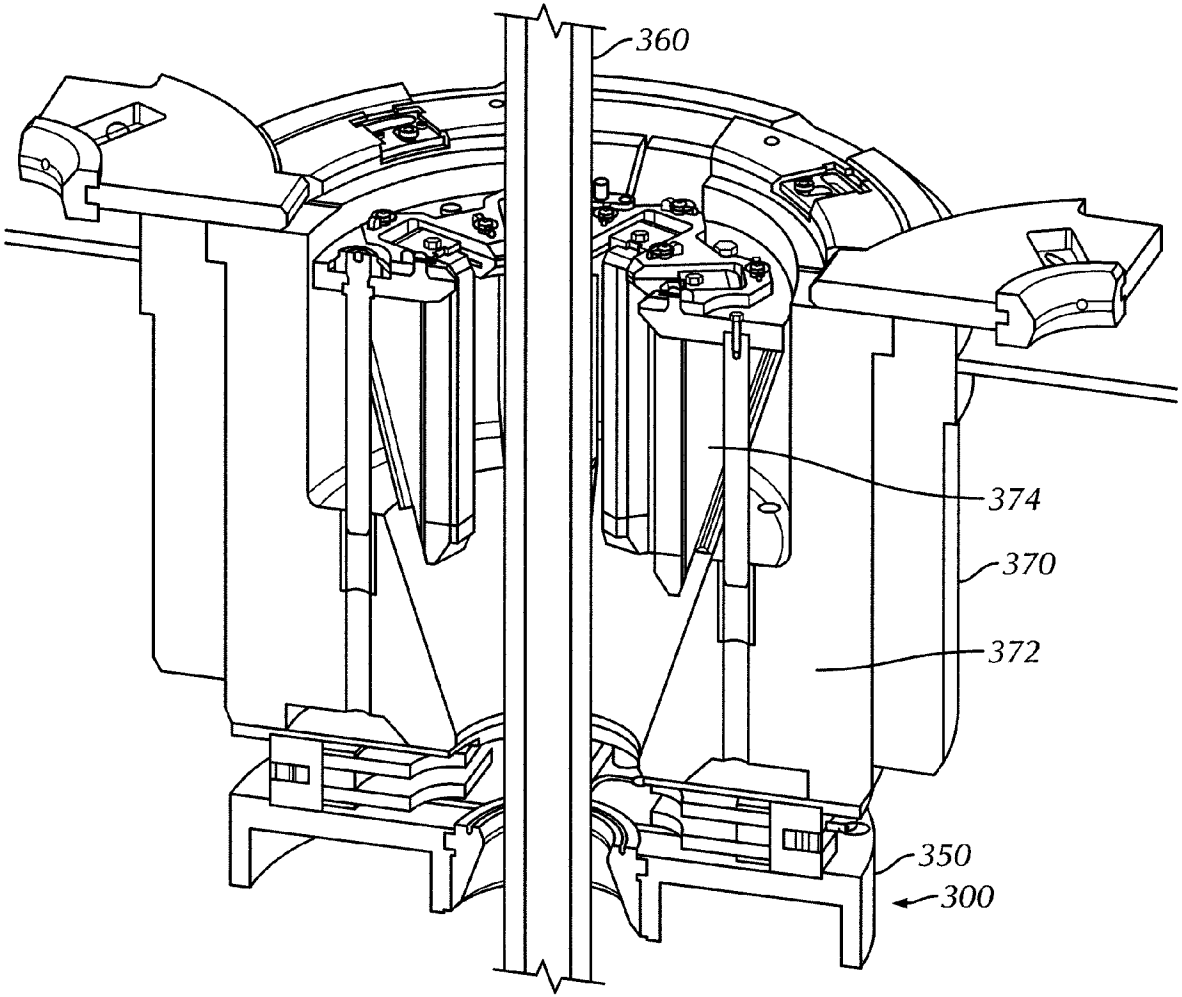
FIG. 3 shows a perspective sectional view of an apparatus connected to a pipe handling apparatus in accordance with one or more embodiments disclosed herein.

Referring now to FIG. 3, a perspective sectional view of an apparatus 300 connected to a pipe handling apparatus 370 in accordance with one or more embodiments disclosed herein are shown. The apparatus 300 may be connected to the pipe handling apparatus 370, such as by having the base 350 of the apparatus 300 connected to the pipe handling apparatus 370. In one or more embodiments, the base 350 may be removably connected to the pipe handling apparatus 370, such that the apparatus 300 may be movable between multiple pipe handling apparatuses.

In the embodiment shown in FIG. 3, the pipe handling apparatus 370 may include a spider, in which the pipe handling apparatus 370 may include a bowl 372 with one or more slip assemblies 374 movably connected to the bowl 372. The slip assemblies 374 may move within the pipe handling apparatus 370 between an open position and a closed position to handle and grip the tubular member 360. As such, the apparatus 300 is movable between the open and closed positions to engage and wipe the tubular member 360 as the tubular member passes through the pipe handing apparatus 370.

Figure 4:
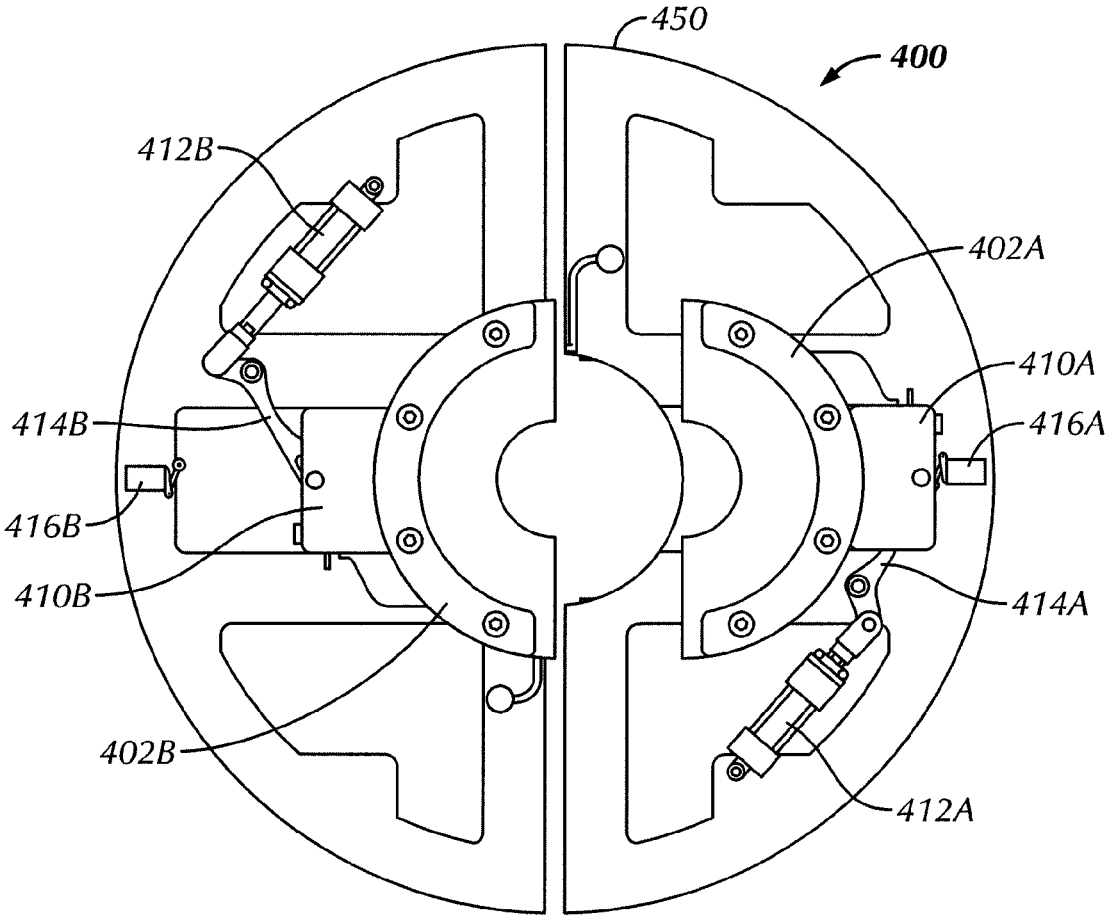
FIG. 4 shows a cross-sectional view of an apparatus to wipe a tubular member in accordance with one or more embodiments disclosed herein.

Referring now to FIG. 4, a cross-sectional view of an apparatus 400 to wipe a tubular member in accordance with one or more embodiments disclosed herein is shown. The apparatus 400 includes a first wiper section 402A and a second wiper section 402B connected to a base 450, in which the first wiper section 402A may be removably connected to the first translating block 410A, and the second wiper section 402B may be removably connected to the second translating block 410B. Further, the first actuator 412A may be connected to the first translating block 410A through the first coupler link 414A, and the second actuator 412B may be connected to the second translating block 410B through the second coupler link 414B. As the actuators 412A and 412B actuate, the first actuator 412A may move the first wiper section 402A between the open and closed positions through the first coupler link 414A and the first translating block 410A, and the second actuator 412B may move the second wiper section 402B between the open and closed positions through the second coupler link 414B and the second translating block 410B.

Further, as discussed above, the apparatus 400 may include one or more position sensors 416 to detect the position of the apparatus. For example, a first position sensor 416A may be coupled to the first wiper section 402A, thereby enabling the first position sensor 416A to detect the position of the first wiper section 402A. Specifically, as shown in FIG. 4, the first position sensor 416A may engage with the first translating block 410A and/or the first coupler link 414A when the first wiper section 402A is in the open position, thereby enabling the first position sensor 416A to indicate that the first wiper section 402A is in the open position.

Similarly, a second position sensor 416B may be coupled to the second wiper section 402B, thereby enabling the second position sensor 416B to detect the position of the second wiper section 402B. As such, and as shown in FIG. 4, the second position sensor 416B may engage with the second translating block 410A and/or the second coupler link 414B when the second wiper section 402B is in the open position, thereby enabling the second position sensor 416B to indicate that the second wiper section 402B is in the open position.

An apparatus in accordance with one or more embodiments of the present disclosure may be useful in multiple areas of drilling. For example, as the apparatus may be disposed adjacent to a pipe handling apparatus, the apparatus may be used to engage and wipe tubular members received within the pipe handling apparatus. This may remove fluid and/or debris (e.g., oil-based and/or water-based mud) from the outer surfaces of the tubular members, thereby increasing the reliability and longevity of the pipe handling apparatus.

Further, as the wiper sections are removably connected within the apparatus, the wiper sections may be replaced at a desired rate and/or as needed. For example, as the wiper sections of the wiper apparatus include flexible materials and components, the wiper sections may need to be removed and replaced regularly, depending on use. Furthermore, as the apparatus may include one or more position sensors therein, the position sensors may be used to determine if one or more components within the apparatus is moving properly.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

What is claimed is:

1. An apparatus to wipe a tubular member, the apparatus comprising:

a first wiper section and a second wiper section;

a position sensor coupled to at least one of the first wiper section and the second wiper section to detect the position of the at least one of the first wiper section and the second wiper section;

a base having a first base section and a second base section, wherein the first wiper section and the second wiper section are removably connected to the first base section and the second base section, respectively, wherein the first wiper section and the second wiper section are parallel to the first base section and the second base section, and wherein the first wiper section and the second wiper section are linearly movable with respect to each other towards a point of convergence;

a first actuator, a first coupler link, and a first translating block connected between the first wiper section and the first base section to linearly move the first wiper section between an open and closed position; and a second actuator, a second coupler link, and a second translating block connected between the second wiper section and the second base section to linearly move the second wiper section between an open and closed position, wherein at least one of the first actuator and the second actuator is disposed such that the at least one of the first actuator and the second actuator actuates in a direction that is offset from a direction in which the first wiper section and the second wiper section move linearly with respect to each other, and wherein at least one of the first coupler link and the second coupler link comprises a pivot point about which the at least one of the first coupler link and the second coupler link rotates to convert offset actuation movement of the at least one of the first actuator and the second actuator into linear movement of the first wiper section and the second wiper section with respect to each other.

2. The apparatus of claim 1, wherein the first wiper section and the second wiper section each comprise a flexible material.

3. The apparatus of claim 1, wherein the first wiper section comprises a first flexible component and the second wiper section comprises a second flexible component.

4. The apparatus of claim 3, wherein:

the first flexible component of the first wiper section is connected to a first rigid component; and the second flexible component of the second wiper section is connected to a second rigid component.

5. The apparatus of claim 1, wherein the apparatus is disposed adjacent to a pipe handling apparatus.

6. The apparatus of claim 1, wherein the at least one of the first wiper section and the second wiper section are removably connected to the base using an attachment mechanism.

7. An apparatus to wipe a tubular member, the apparatus comprising:

a base having an aperture formed therein to receive the tubular member;

a first wiper section and a second wiper section connected to the base and linearly movable with respect to the base between an open position and a closed position, wherein the first wiper section and the second wiper section are parallel to the base;

a position sensor coupled to at least one of the first wiper section and the second wiper section to detect the position of the at least one of the first wiper section and the second wiper section;

a first actuator, a first coupler link, and a first translating block connected between the first wiper section and the base to linearly move the first wiper section between an open and closed position; and a second actuator, a second coupler link, and a second translating block connected between the second wiper section and the base to linearly move the second wiper section between an open and closed position, wherein at least one of the first actuator and the second actuator is disposed such that the at least one of the first actuator and the second actuator actuates in a direction that is offset from a direction in which the first wiper section and the second wiper section move linearly with respect to each other; and wherein at least one of the first coupler link and the second coupler link comprises a pivot point about which the at least one of the first coupler link and the second coupler link rotates to convert offset actuation movement of the at least one of the first actuator and the second actuator into linear movement of the first wiper section and the second wiper section with respect to each other.

8. The apparatus of claim 7, wherein the base is connected to a pipe handling apparatus, the pipe handling apparatus configured to receive the tubular member.

9. The apparatus of claim 8, wherein the pipe handling apparatus comprises a bowl having a plurality of slip assemblies movably connected thereto.

10. The apparatus of claim 7, wherein the first wiper section and the second wiper section are linearly movable with respect to an axis of the aperture of the base between the open position and the closed position, and wherein a direction of linear movement of the first wiper section and the second wiper section is orthogonal to the axis of the aperture of the base.

11. The apparatus of claim 7, wherein the first wiper section and the second wiper section each comprise a flexible material.

12. The apparatus of claim 7, wherein:

the first wiper section is removably connected to the base using a first attachment mechanism; and the second wiper section is removably connected to the base using a second attachment mechanism.

13. A method to manufacture an apparatus to wipe a tubular member, the method comprising:

connecting a first wiper section to a base such that the first wiper section is parallel to the base;

connecting a second wiper section to the base such that the second wiper section is parallel to the base;

connecting a position sensor coupled to at least one of the first wiper section and the second wiper section, the position sensor to detect the position of the at least one of the first wiper section and the second wiper section;

connecting a first actuator, a first coupler link, and a first translating block between the first wiper section and the base, wherein connecting a first actuator, a first coupler link, and a first translating block comprises:

disposing at least one of the first actuator and the second actuator such that the at least one of the first actuator and the second actuator actuates in a direction that is offset from a direction in which the first wiper section and the second wiper section move linearly with respect to each other; and forming a pivot point on at least one of the first coupler link and the second coupler link about which the at least one of the first coupler link and the second coupler link rotates to convert offset actuation movement of the at least one of the first actuator and the second actuator into linear movement of the first wiper section and the second wiper section with respect to each other; and connecting a second actuator, a second coupler link, and a second translating block between the second wiper section and the base, wherein the first wiper section and the second wiper section are linearly movable with respect to each other.

14. The method of claim 13, wherein the first wiper section and the second wiper section are linearly movable with respect to each other towards a point of convergence.

15. The method of claim 13, further comprising:

connecting the base to a pipe handling apparatus.

16. The method of claim 13, wherein the base comprises a first base section and a second base section, wherein connecting the first wiper section to the base and connecting the second wiper section to the base comprise, respectively:

removably connecting the first wiper section to the first base section; and removably connecting the second wiper section to the second base section.

17. An apparatus to wipe a tubular member, the apparatus comprising:

a first means for wiping the tubular member coupled to a means for handling the tubular member;

a second means for wiping the tubular member coupled to the handling means;

a position sensor coupled to at least one of the first means for wiping the tubular member and the second means for wiping the tubular member to detect a position of the at least one of the first means for wiping the tubular member and the second means for wiping the tubular member; and a first means for linearly moving the first wiping means, a first coupling means, and a first translating means connected between the first wiping means and the handling means to linearly move the first wiping means between an open and closed position; and a second means for linearly moving the second wiping means, a second coupling means, and a second translating means connected between the second wiping means and the handling means to linearly move the second wiping means between an open and closed position, wherein the first wiping means and the second wiping means are linearly movable with respect to each other towards a point of convergence, wherein the first wiping means and the second wiping means are removably connected to the handling means, wherein the first wiping means and the second wiping means are parallel to the handling means, wherein at least one of the linear moving means of the first wiping means and the linear moving means of the second wiping means is disposed such that the at least one of the linear moving means of the first wiping means and the linear moving means of the second wiping means actuates in a direction that is offset from a direction in which the first wiping means and the second wiping means move linearly with respect to each other, and wherein at least one of the first coupling means and the second coupling means comprises a pivoting means about which the at least one of the first coupling means and the second coupling means rotates to convert offset actuation movement of the at least one of the linear moving means of the first wiping means and the linear moving means of the second wiping means into linear movement of the first wiping means and the second wiping means with respect to each other.

18. The apparatus of claim 17, further comprising:

a means for removably connecting the first wiping means and the second wiping means to the means for handling the tubular member.

19. The apparatus of claim 18, wherein:

the connecting means comprises a first connecting means and a second connecting means;

the first connecting means is configured to connect the first wiping means to the handling means; and the second connecting means is configured to connect the second wiping means to the handling means.

20. The apparatus of claim 18, wherein:

the first wiping means comprises a first wiper section;

the second wiping means comprises a second wiper section; and the connecting means comprises a base.

21. The apparatus of claim 17, wherein:

the first wiping means comprises a first rigid means and a first flexible means;

the first rigid means is configured to wipe the tubular member;

the second wiping means comprises a second rigid means and a second flexible means; and the second rigid means is configured to wipe the tubular member.

* * * * *